US010044152B2

(12) United States Patent
Rajpal

(10) Patent No.: US 10,044,152 B2
(45) Date of Patent: Aug. 7, 2018

(54) DIELECTRIC SPACER FOR COAXIAL CABLE AND CONNECTOR

(71) Applicant: CommScope Technologies LLC, Hickory, NC (US)

(72) Inventor: Taig S. Rajpal, Chicago, IL (US)

(73) Assignee: CommScope Technologies LLC, Hickory, NC (US)

( * ) Notice: Subject to any disclaimer, the term of this patent is extended or adjusted under 35 U.S.C. 154(b) by 106 days.

(21) Appl. No.: 15/008,128

(22) Filed: Jan. 27, 2016

(65) Prior Publication Data

US 2016/0233627 A1 Aug. 11, 2016

Related U.S. Application Data

(60) Provisional application No. 62/114,303, filed on Feb. 10, 2015.

(51) Int. Cl.

| | |
|---|---|
| ***H01R 24/38*** | (2011.01) |
| ***H01R 4/48*** | (2006.01) |
| ***H01R 9/05*** | (2006.01) |

(52) U.S. Cl.

CPC ..... *H01R 24/38* (2013.01); *H01R 9/0524* (2013.01)

(58) Field of Classification Search

CPC ..... H01R 24/38; H01R 9/0524

See application file for complete search history.

(56) References Cited

U.S. PATENT DOCUMENTS

| | | | | |
|---|---|---|---|---|
| 4,431,255 | A * | 2/1984 | Banning | H01R 9/0521 439/578 |
| 5,456,611 | A | 10/1995 | Henry et al. | |
| 7,588,460 | B2 | 9/2009 | Malloy et al. | |
| 7,798,848 | B2 * | 9/2010 | Islam | H01R 4/5075 439/578 |
| 7,922,528 | B2 * | 4/2011 | Jackson | H01R 24/44 439/578 |

(Continued)

OTHER PUBLICATIONS

International Search Report and Written Opinion for corresponding PCT Application No. PCT/US2016/016554, dated May 16, 2016, 11 pages.

(Continued)

*Primary Examiner* — Briggitte R Hammond

(74) *Attorney, Agent, or Firm* — Myers Bigel, P.A.

(57) ABSTRACT

Coaxial connectors include: a generally cylindrical inner contact configured at one end to mate with a corresponding inner contact of a mating connector and at an opposite end to engage an inner conductor of a coaxial cable; a generally cylindrical outer conductor body spaced apart from and circumferentially surrounding the inner contact and configured at one end to mate with a corresponding outer conductor body contact of a mating connector and at an opposite end to electrically connect with an outer conductor of the coaxial cable; a first dielectric spacer interposed between the inner contact and the outer conductor body; and a second dielectric spacer interposed between the inner contact and the outer conductor body and including axially-extending fingers. The second dielectric spacer engages the outer conductor body so that the fingers exert radially-inwardly directed pressure on the inner conductor of the coaxial cable that engages the inner contact.

13 Claims, 3 Drawing Sheets

(56) References Cited

U.S. PATENT DOCUMENTS

| | | | | |
|---|---|---|---|---|
| 2001/0051448 | A1 | 12/2001 | Gonzales | |
| 2005/0079760 | A1* | 4/2005 | Vaccaro ..... | H01R 9/0521<br>439/578 |
| 2006/0141829 | A1 | 6/2006 | Kauth | |
| 2011/0263154 | A1 | 10/2011 | Chawgo et al. | |

OTHER PUBLICATIONS

Notification Concerning Transmittal of International Preliminary Report on Patentability for corresponding PCT Application No. PCT/US2016/016554, dated Aug. 24, 2017.

* cited by examiner

DIELECTRIC SPACER FOR COAXIAL CABLE AND CONNECTOR

RELATED APPLICATION

The present application claims the benefit of an priority from U.S. Provisional Patent Application No. 62/114,303, filed Feb. 10, 2015, the disclosure of which is hereby incorporated herein in its entirety.

FIELD OF THE INVENTION

The present invention is directed generally to electrical cable connectors, and more particularly to coaxial connectors for electrical cable.

BACKGROUND

Coaxial cables are commonly utilized in RF communications systems. A typical coaxial cable includes an inner conductor, an outer conductor, a dielectric layer that Separates the inner and outer conductors, and a jacket that covers the outer conductor. Coaxial cable connectors may be applied to terminate coaxial cables, for example, in communication systems requiring a high level of precision and reliability.

Coaxial connector interfaces provide a connect/disconnect functionality between (a) a cable terminated with a connector bearing the desired connector interface and (b) a corresponding connector with a mating connector interface mounted on an apparatus or On another cable. Typically, one connector will include a structure such as a pin or post connected to an inner conductor of the coaxial cable and an outer conductor connector body connected to the outer conductor of the coaxial cable; these are mated with a mating sleeve (for the pin or post of the inner conductor) and another outer conductor connector body of a second connector. Coaxial connector interfaces often utilize a threaded coupling nut or other retainer that draws the connector interface pair into secure electro-mechanical engagement when the coupling nut (which is captured by one of the connectors) is threaded onto the other connector. The pin/post and outer conductor body are typically separated with one or more dielectric spacers.

SUMMARY

As a first aspect, embodiments of the invention are directed to a coaxial connector. The coaxial connector comprises: a generally cylindrical inner contact configured at one end to mate with a corresponding inner contact of a mating connector and configured at an opposite end to engage an inner conductor of a coaxial cable; a generally cylindrical outer conductor body spaced apart from and circumferentially surrounding the inner contact, the outer conductor body configured at one end to mate with a corresponding outer conductor body contact of a mating connector and configured at an opposite end to electrically connect with an outer conductor of the coaxial cable; a first dielectric spacer interposed between the inner contact and the outer conductor body; and a second dielectric spacer interposed between the inner contact and the outer conductor body, the second dielectric spacer including axially-extending fingers. The second dielectric spacer engages the outer conductor body so that the fingers exert radially-inwardly directed pressure on the inner conductor of the coaxial cable that engages the inner contact.

As a second aspect, embodiments of the invention are directed to a combination comprising a coaxial connector as described above and a coaxial cable, wherein the inner conductor of the coaxial cable engages the inner contact, and the outer conductor of the coaxial cable is electrically connected with the outer conductor body.

As a third aspect, embodiments of the invention are directed to a dielectric spacer for a coaxial connector, comprising an annular tower and a plurality of axially-extending fingers. Each of the fingers includes a radially-outwardly extending foot. The spacer is a monolithic component.

DETAILED DESCRIPTION OF EMBODIMENTS OF THE INVENTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
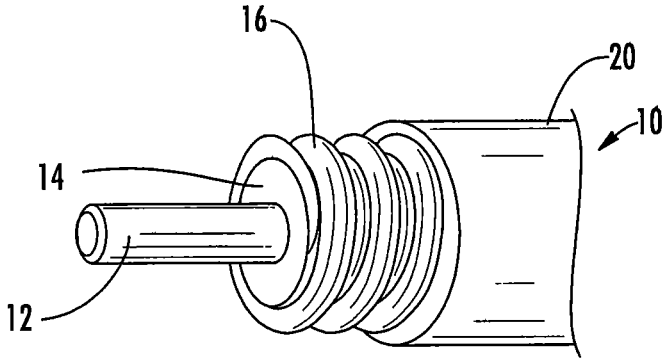
FIG. 1 is a perspective view of the end of a coaxial cable suitable for use with coaxial connectors according to embodiments of the invention.

FIG. 1 illustrates a coaxial cable, designated broadly at 10. The cable 10 includes a inner conductor 12, a dielectric layer 14 that circumferentially overlies the inner conductor 12, an outer conductor 16 that circumferentially overlies the dielectric layer 14, and a polymeric cable jacket 20 that circumferentially overlies the outer conductor 16. These components will be well-known to those of skill in this art and need not be described in detail herein. FIG. 1 illustrates that the outer conductors 16 has a corrugated profile; alternatively, the outer conductor 16 may have a smooth or braided profile. All of these outer conductor configurations are known to those of skill in this art and need not be described in detail herein.

Figure 2:
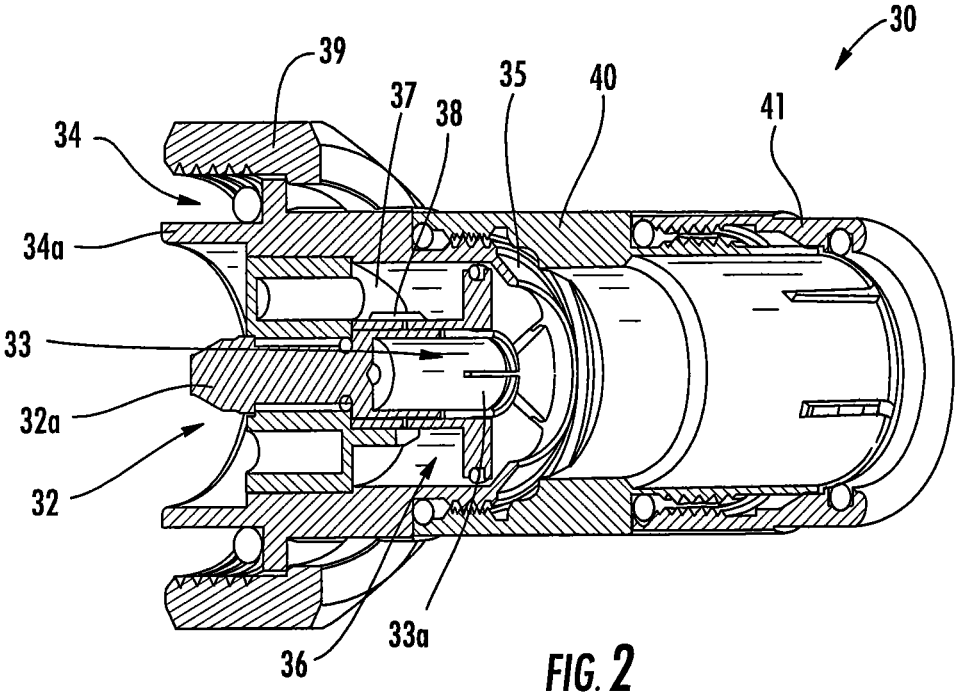
FIG. 2 is a perspective section view of a coaxial connector according to embodiments of the invention.

Referring now to FIG. 2, a plug 30 that is to be attached to the cable 10 is shown therein. The plug 30 includes an inner contact 32, an outer conductor body 34, intermediate and back overmold bodies 40, 41, and a coupling nut 39. The inner contact 32 has a generally cylindrical post 32*a* and a split boss 33 with tines 33*a*. The inner contact 32 is configured to be mounted on and in electrical contact with the inner conductor 12 of the cable 10 via the boss 33; the split configuration of the boss 33 allows the tines 33*a* to deflect slightly radially outwardly to receive the end of the inner conductor 12. The post 32*a* is configured to mate with an inner contact (such as a sleeve) of a mating jack or other connector.

Referring again to FIG. 2, the outer conductor body 34 is configured to be mounted in electrical contact with the outer conductor 16 of the coaxial cable 10 via a bevelled lip 35 that is soldered to the outer conductor 16. A mating ring 34*a* of the Outer conductor 34 is configured to mate with the outer conductor body of a mating jack or other connector. An annular dielectric spacer 37 is positioned between the inner contact 32 and the outer conductor body 34 near the mating ring 34*a* and maintains separation between the inner contact 32 and the outer conductor extension 34. The dielectric spacer 37 has a ring 38 that overlies a portion of the boss 33 of the inner contact 32.

Figure 3:
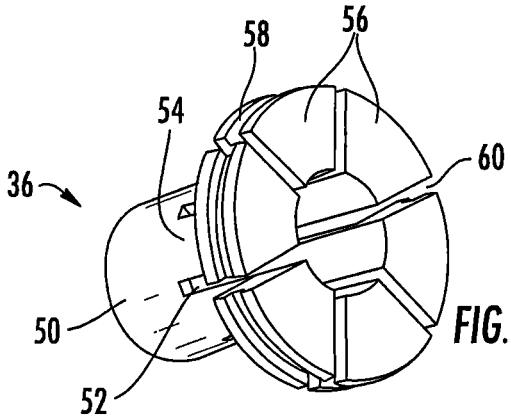
FIG. 3 is a perspective view of the dielectric spacer of the coaxial connector of FIG. 2.
Figure 4:
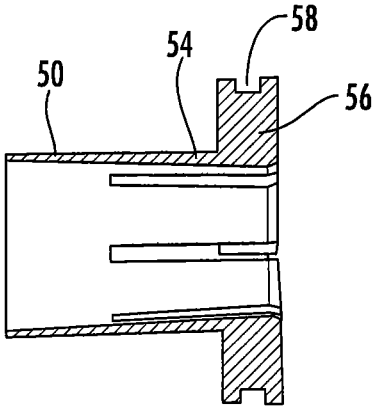
FIG. 4 is a section view of the dielectric spacer of FIG. 3.
Figure 5:
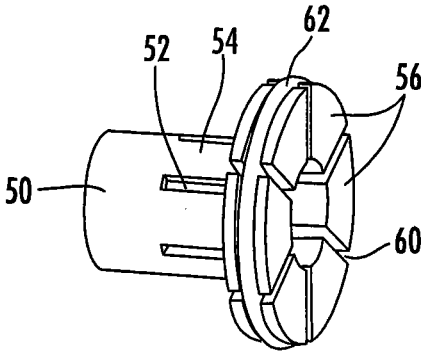
FIG. 5 is a perspective view of the dielectric spacer of FIG. 3 with an O-ring in place in the recesses of the feet of the spacer.

Referring still to FIG. 2, and also to FIGS. 3-5, a second dielectric spacer 36 is positioned between the inner contact 32 and the outer conductor body 34 nearer the junction between the central conductor 12 and the central conductor extension 32. The spacer 36 (shown by itself in FIGS. 3 and 4) includes a hollow tower 50 and fingers 54 separated by axial slots 52. Each of the fingers 54 has a radially outwardly-extending foot 56 with a circumferential recess 58. Gaps 60 are present between adjacent feet 54. In the illustrated embodiment, an O-ring 62 is positioned in the recesses 58 of the fingers 54 (see FIG. 5). As can be seen in FIG. 4, in some embodiments the inner surfaces of the tower 50 and the fingers 54 taper radially inwardly, such that the bore formed inside the tower 50 and fingers 54 is wider at the free end of the tower 50.

The dielectric spacer 36 is typically formed of a polymeric material, such as polypropylene, PTFE, polymethylpentene and cross-linked polystyrene. In some embodiments, the dielectric spacer 36 is formed by injection molding.

As can be seen in FIG. 2, the dielectric spacer 36 is positioned with the free end of the tower 50 between the ring 38 of the spacer 37 and the boss 33 of the inner contact 32. The opposite end of the spacer 36 is positioned such that the O-ring 62 engages the inner surface of the outer conductor body 34 near the bevelled lip 35. The fingers 54 flex radially inwardly due to the engagement of the O-ring 62 in the outer conductor body 34. As a result, the inner surfaces of the fingers 54 apply radially-inwardly directed pressure on the tines 33*a* of the split boss 33 of the inner contact 32, which in turn causes the tines 33*a* to grip the inner conductor 12 of the cable 10. Consequently, the electrical connection between the inner conductor 12 and the inner contact 32 can be made without a solder joint and, therefore, can improve the electrical performance of the connector (e.g., it may have lower levels of undesirable passive intermodulation (PIM). Additionally, the presence of the dielectric spacer 36 can help to center the inner conductor 12 relative to the inner contact 32, which can also produce more consistent electrical performance.

Figure 6:
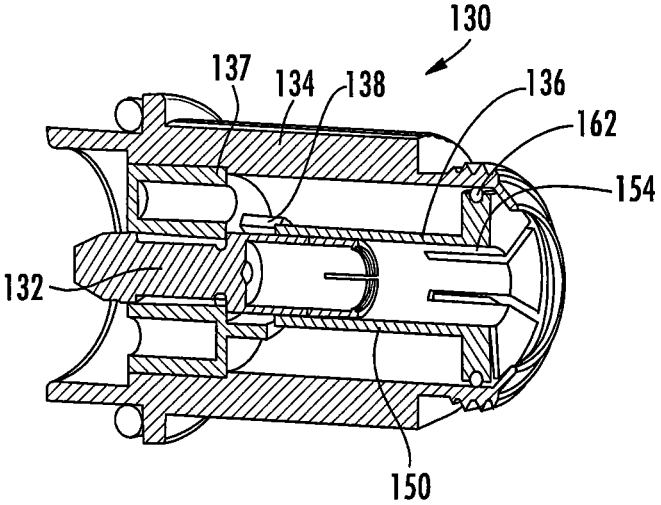
FIG. 6 is a perspective section view of a coaxial connector according to alternative embodiments of the invention.

Referring now to FIG. 6, another embodiment of a connector, designated broadly at 130, is shown therein. In this embodiment, the outer conductor body 134 is longer than the outer conductor body 34 discussed above, such that the tower 150 of the dielectric spacer 136 abuts the ring 138 of the spacer 137. Consequently, the fingers 154 of the spacer 136 clamp directly onto and apply pressure directly to the inner conductor 12 of the cable 10 as the O-ring 162 engages the inner surface of the outer conductor body 134. As a result, the inner conductor 12 is held in place by two different sets of clamping fingers/tines (those of the spacer 136 and the inner contact 132), so that the clamping pressure is spread over a greater length of the inner conductor 12.

Figure 7:
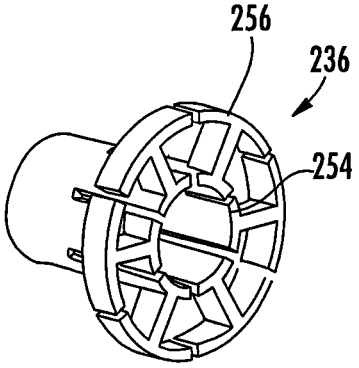
FIG. 7 is a perspective view of a dielectric spacer according to further embodiments of the invention.
Figure 8:
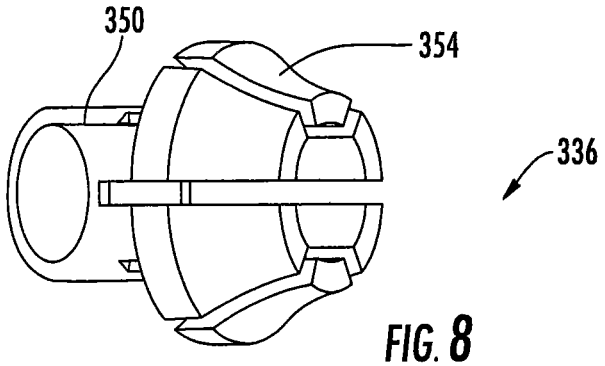
FIG. 8 is a perspective view of a dielectric spacer according to additional embodiments of the invention.
Figure 9:
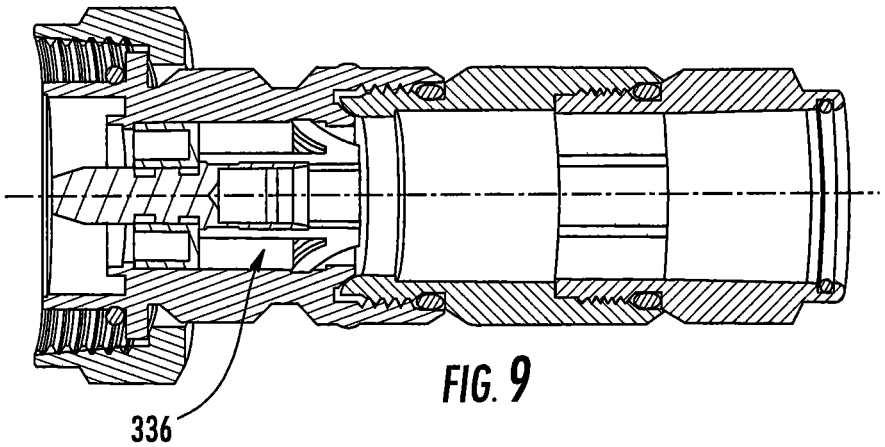
FIG. 9 is a perspective section view of the dielectric spacer of FIG. 8 in place with a coaxial connector.
Figure 10:
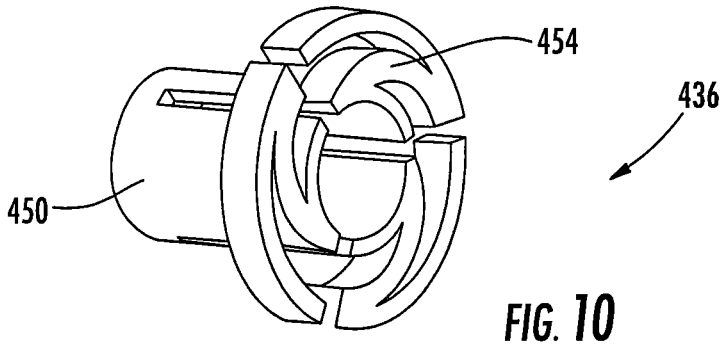
FIG. 10 is a perspective view of a dielectric spacer according to further embodiments of the invention.
Figure 11:
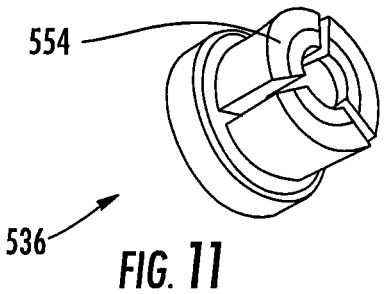
FIG. 11 is a perspective view of a dielectric spacer according to still further embodiments of the invention.
Figure 12:
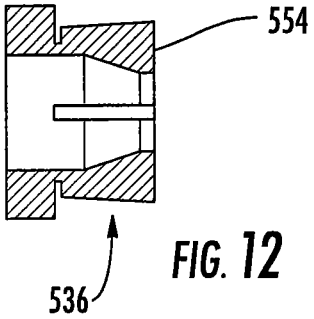
FIG. 12 is a section view of the dielectric spacer of FIG. 11.

Those skilled in this art will appreciate that the spacer and connector may take different forms. For example, and as shown in FIG. 7, the spacer 236 may have fingers 254 that lack a recess for an O-ring, such that the fingers 254 themselves directly engage the inner surface of the outer conductor body (rather than engaging the inner surface of the outer conductor body indirectly through the O-rings 62, 162). As another alternative, a spacer 336 may have generally an umbrella-shaped configuration, such that the fingers 354 extend radially outwardly at an oblique angle to the tower 350 (see FIGS. 8 and 9). As a further alternative, a spacer 436 may have fingers 454 that extend normal but non-diametrically to the tower 450 (see FIG. 10). As a still further alternative, a spacer 536 may have fingers 554 with severely tapered inner surfaces, such that they extend significantly radially when positioned on an inner contact or inner conductor (see FIGS. 11 and 12). Other configurations may be recognized by those of skill in this art.

Also, in some embodiments, the spacer may include more or fewer fingers, and/or the inner surfaces of the tower and fingers may not form a tapered bore. The connector may lack one or both of the overmold bodies 40, 41. The inner contact 32 may have more or fewer tines 33*a*, or lack such tines altogether. Other variations will be apparent to those of skill in this art.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A coaxial connector, comprising:

a generally cylindrical inner contact configured at one end to mate with a corresponding inner contact of a mating connector and configured at an opposite end to engage an inner conductor of a coaxial cable;

a generally cylindrical outer conductor body spaced apart from and circumferentially surrounding the inner contact, the outer conductor body configured at one end to mate with a corresponding outer conductor body contact of a mating connector and configured at an opposite end to electrically connect with an outer conductor of the coaxial cable;

a first dielectric spacer interposed between the inner contact and the outer conductor body; and a second dielectric spacer interposed between the inner contact and the outer conductor body, the second dielectric spacer including axially-extending fingers;

wherein the second dielectric spacer engages the outer conductor body so that the fingers exert radially-inwardly directed pressure on the inner conductor of the coaxial cable that engages the inner contact; and wherein the second dielectric spacer further comprises an O-ring that encircles the fingers and directly engages the outer conductor body to cause the fingers to exert radially-inwardly directed pressure on the inner conductor of the coaxial cable.

2. The coaxial connector defined in claim 1, wherein each of the fingers includes a recess, and wherein the O-ring fits within the recesses of the fingers.

3. The coaxial connector defined in claim 2, wherein each of the fingers includes a radially-outwardly extending foot, and wherein the recess of each finger is located in the foot.

4. The coaxial connector defined in claim 1, wherein the fingers are configured to directly engage the inner conductor of the coaxial cable.

5. The coaxial connector defined in claim 4, wherein the first dielectric spacer includes a ring, and wherein a portion of the second dielectric spacer fits within the ring.

6. A coaxial connector, comprising:

a generally cylindrical inner contact configured at one end to mate with a corresponding inner contact of a mating connector and configured at an opposite end to engage an inner conductor of a coaxial cable;

a generally cylindrical outer conductor body spaced apart from and circumferentially surrounding the inner contact, the outer conductor body configured at one end to mate with a corresponding outer conductor body contact of a mating connector and configured at an opposite end to electrically connect with an outer conductor of the coaxial cable;

a first dielectric spacer interposed between the inner contact and the outer conductor body; and a second dielectric spacer interposed between the inner contact and the outer conductor body, the second dielectric spacer including axially-extending fingers;

wherein the second dielectric spacer engages the outer conductor body so that the fingers exert radially-inwardly directed pressure on the inner conductor of the coaxial cable that engages the inner contact; and wherein the fingers are configured to directly engage inner contact, and wherein the inner contact includes tines that deflect radially inwardly due to deflection of the fingers to directly engage the inner conductor.

7. A coaxial connector, comprising:

a generally cylindrical inner contact configured at one end to mate with a corresponding inner contact of a mating connector;

a generally cylindrical outer conductor body spaced apart from and circumferentially surrounding the inner contact, the outer conductor body configured at one end to mate with a corresponding outer conductor body contact of a mating connector;

a first dielectric spacer interposed between the inner contact and the outer conductor body: and a second dielectric spacer interposed between the inner contact and the outer conductor body, the second dielectric spacer including axially-extending fingers;

the connector in combination with a coaxial cable, wherein the inner conductor of the coaxial cable engages the inner contact, and the outer conductor of the coaxial cable is electrically connected with the outer conductor body;

wherein the second dielectric spacer engages the outer conductor body so that the fingers exert radially-inwardly directed pressure on the inner conductor of the coaxial cable that engages the inner contact.

8. The combination defined in claim 7, wherein the second dielectric spacer further comprises an O-ring that encircles the fingers and directly engages the outer conductor body to cause the fingers to exert radially inwardly directed pressure on the inner conductor of the coaxial cable.

9. The combination defined in claim 8, wherein each of the fingers includes a recess, and wherein the O-ring fits within the recesses of the fingers.

10. The combination defined in claim 9, wherein each of the fingers includes a radially-outwardly extending foot, and wherein the recess of each finger is located in the foot.

11. The combination defined in claim 7, wherein the fingers directly engage the inner conductor of the coaxial cable.

12. The combination defined in claim 11, wherein the first dielectric spacer includes a ring, and wherein a portion of the second dielectric spacer fits within the ring.

13. The combination defined in claim 7, wherein the fingers directly engage the inner contact, and wherein the inner contact includes tines that deflect radially inwardly due to deflection of the fingers to directly engage the inner conductor.

* * * * *